US007530933B2

(12) United States Patent
Chen

(10) Patent No.: US 7,530,933 B2
(45) Date of Patent: May 12, 2009

(54) RESISTANCE GENERATING DEVICE FOR A TRAINING BICYCLE

(75) Inventor: Johnny Chen, Miao Li Hsien (TW)

(73) Assignee: Giant Manufacturing Co., Ltd., Taichung Hsien (TW)

( * ) Notice: Subject to any disclaimer, the term of this patent is extended or adjusted under 35 U.S.C. 154(b) by 287 days.

(21) Appl. No.: 11/333,314

(22) Filed: Jan. 18, 2006

(65) Prior Publication Data

US 2007/0167295 A1 Jul. 19, 2007

(51) Int. Cl.
*A63B 22/06* (2006.01)

(52) U.S. Cl. ..... 482/63; 482/61

(58) Field of Classification Search ..... 482/51, 482/52, 56, 57, 60, 61, 62, 63, 110, 903, 482/908

See application file for complete search history.

(56) References Cited

U.S. PATENT DOCUMENTS 5,472,392 A * 12/1995 Haan et al. ..... 482/61
6,620,081 B2 * 9/2003 Phillips ..... 482/57
6,736,761 B2 5/2004 Huang
7,011,607 B2 * 3/2006 Kolda et al. ..... 482/57
7,101,320 B2 * 9/2006 Qiu ..... 482/63

* cited by examiner

*Primary Examiner*—Loan H Thanh
*Assistant Examiner*—Tam Nguyen
(74) *Attorney, Agent, or Firm*—Harness, Dickey & Pierce P.L.C.

(57) ABSTRACT

A resistance generating device includes a friction wheel adapted to frictionally engage a bicycle wheel of a training bicycle to be rotated therewith, a first magnetically attractive member, and a second magnetically attractive member which is rotated with the friction wheel, and which is disposed to be spaced apart from the first magnetically attractive member. The first and second magnetically attractive members are configured to be shiftable towards or away from each other in response to the higher or lower speed of the second magnetically attractive member so as to increase or decrease a magnetically induced resistance force generated therebetween to be imparted to the bicycle wheel. The actuating mechanism is disposed to effect the relative shifting movement in response to the higher speed to force the first and second magnetically attractive members towards each other, thereby increasing the resistance force.

5 Claims, 10 Drawing Sheets

RESISTANCE GENERATING DEVICE FOR A TRAINING BICYCLE

BACKGROUND OF THE INVENTION

1. Field of the Invention

This invention relates to a resistance generating device for a training bicycle, more particularly to a resistance generating device which imparts an increased resistance force to a wheel of a training bicycle in response to a higher rotation speed of the wheel.

2. Description of the Related Art

In U.S. Pat. No. 6,736,761 B2, entitled "Stationary Bicycle Resistance Generator," a support unit is disposed to suspend a bicycle wheel of a stationary bicycle exerciser from a ground surface so as to permit rotation of the bicycle wheel. A resistance unit includes a friction wheel which is rotatably mounted on a rotating shaft and which frictionally engages the bicycle wheel to be rotated therewith, a magnetically attractive member which is mounted on the rotating shaft and which is disposed at a side of the friction wheel, and a plurality of magnets which surround the magnetically attractive member and which are angularly displaced from one another such that, when the bicycle wheel is rotated by means of a pedaling action to rotate the friction wheel, a magnetically induced resistance force is generated by the magnets and is imparted to the bicycle wheel for training purposes.

Although the resistance force can be varied by adjusting the distance between the magnetically attractive member and the magnets, during pedaling of the bicycle at a higher speed, an inertia and a centrifugal force resulting from the rotation of the bicycle wheel will counteract a part of the resistance force so that the resistance effect is reduced.

SUMMARY OF THE INVENTION

The object of the present invention is to provide a resistance generating device for a training bicycle which can impart an increased resistance force to a wheel of the training bicycle in response to a higher rotation speed of the wheel.

According to this invention, the resistance generating device includes a seat which is adapted to be mounted on a support stand that suspends a bicycle wheel of a training bicycle from a ground surface, a rotatable shaft which is mounted on and which is rotatable relative to the seat about a rotating axis, a friction wheel which is mounted on and which is rotatable with the rotatable shaft about the rotating axis, and which is adapted to frictionally engage the bicycle wheel so as to be rotated therewith, a first magnetically attractive member which is disposed to surround the rotating axis, a second magnetically attractive member which is mounted to be rotatable with the rotatable shaft at a higher or lower speed, and which is disposed to be spaced apart from the first magnetically attractive member along the rotating axis, a biasing member which is disposed to bias the first and second magnetically attractive members away from each other, and an actuating mechanism. The first and second magnetically attractive members are configured to be shiftable towards or away from each other along the rotating axis in response to the higher or lower speed of the second magnetically attractive member so as to increase or decrease a magnetically induced resistance force generated therebetween to be imparted to the bicycle wheel. The actuating mechanism is disposed on one of the first and second magnetically attractive members to effect the relative shifting movement of the first and second magnetically attractive members in response to the higher speed of the rotatable shaft to force the first and second magnetically attractive members towards each other against the biasing force of the biasing member, thereby increasing the resistance force.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
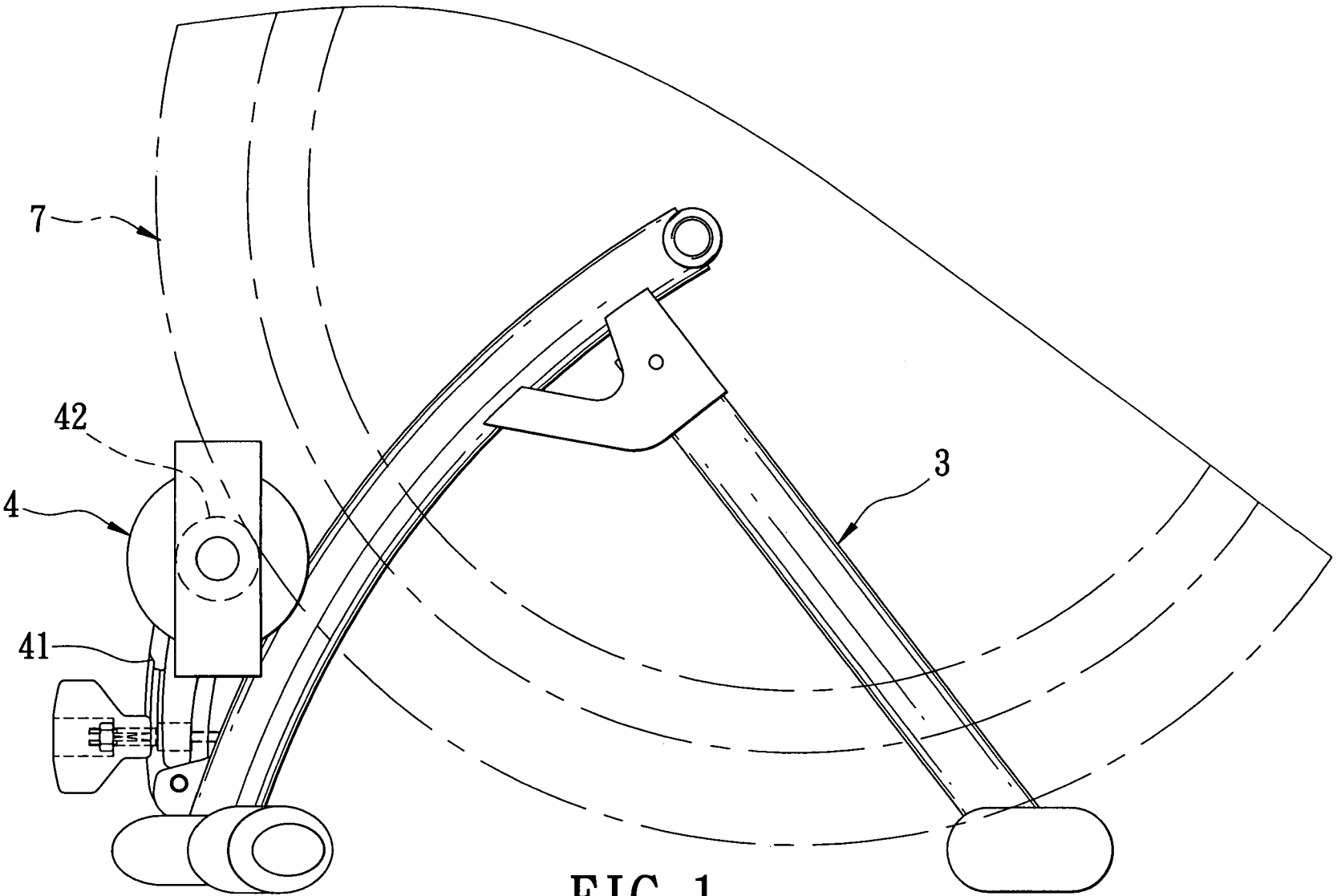
FIG. 1 is a schematic view of the first preferred embodiment of a resistance generating device according to this invention when mounted to a training bicycle.

Before the present invention is described in greater detail, it should be noted that same reference numerals have been used to denote like elements throughout the specification.

Figure 2:
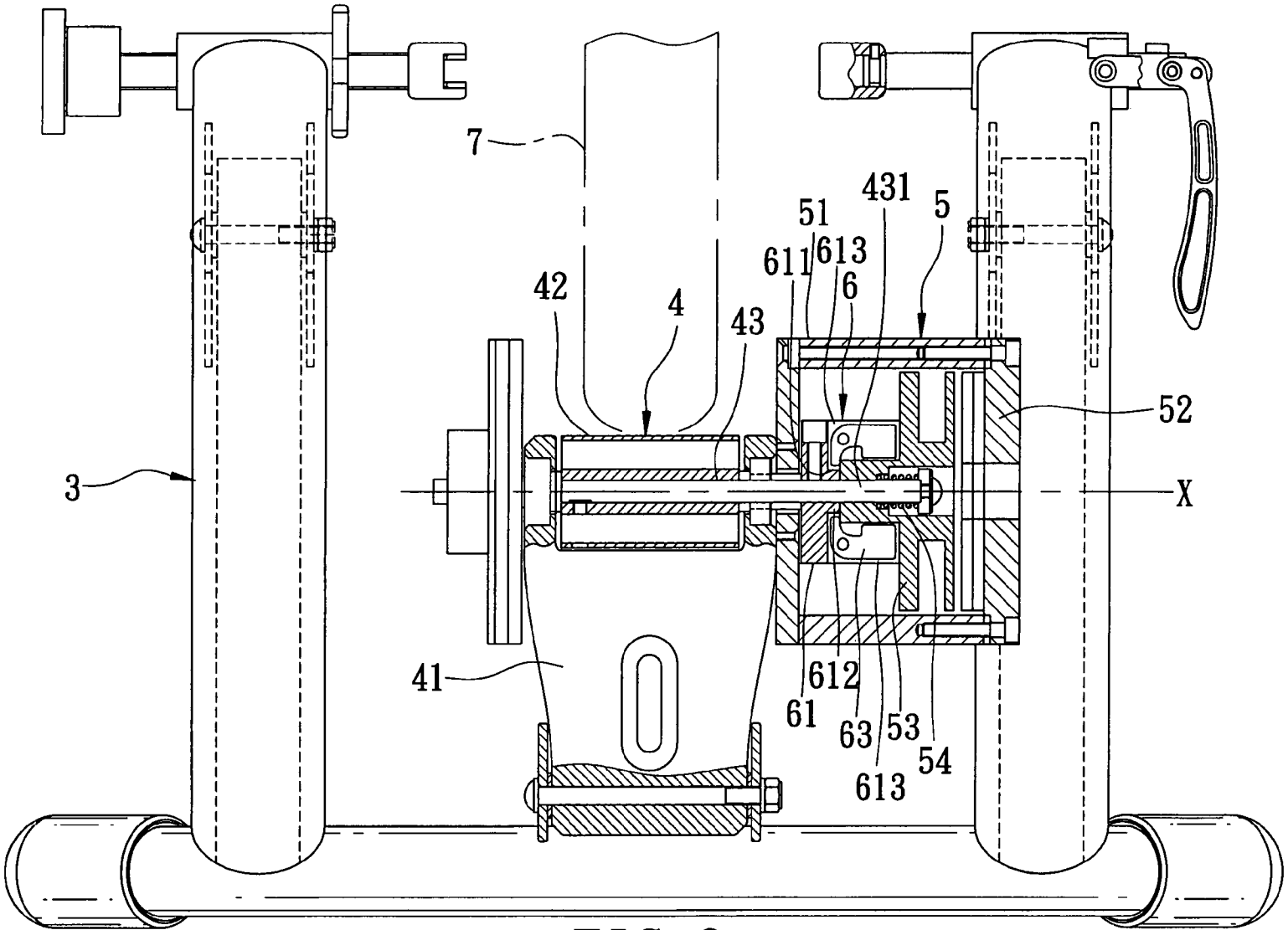
FIG. 2 is a sectional view of the first preferred embodiment.
Figure 3:
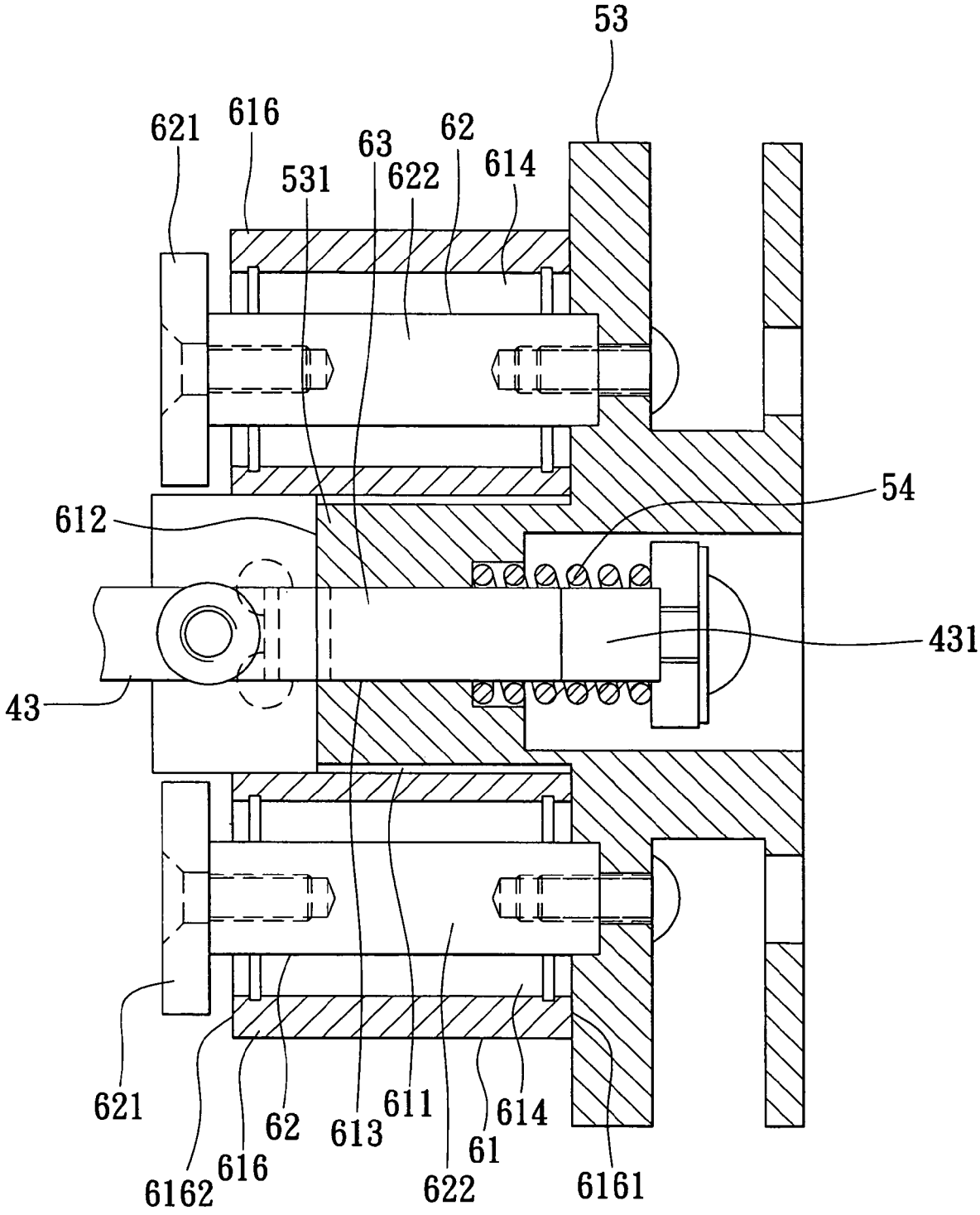
FIG. 3 is a fragmentary sectional view taken along line (X) of FIG. 2.
Figure 4:
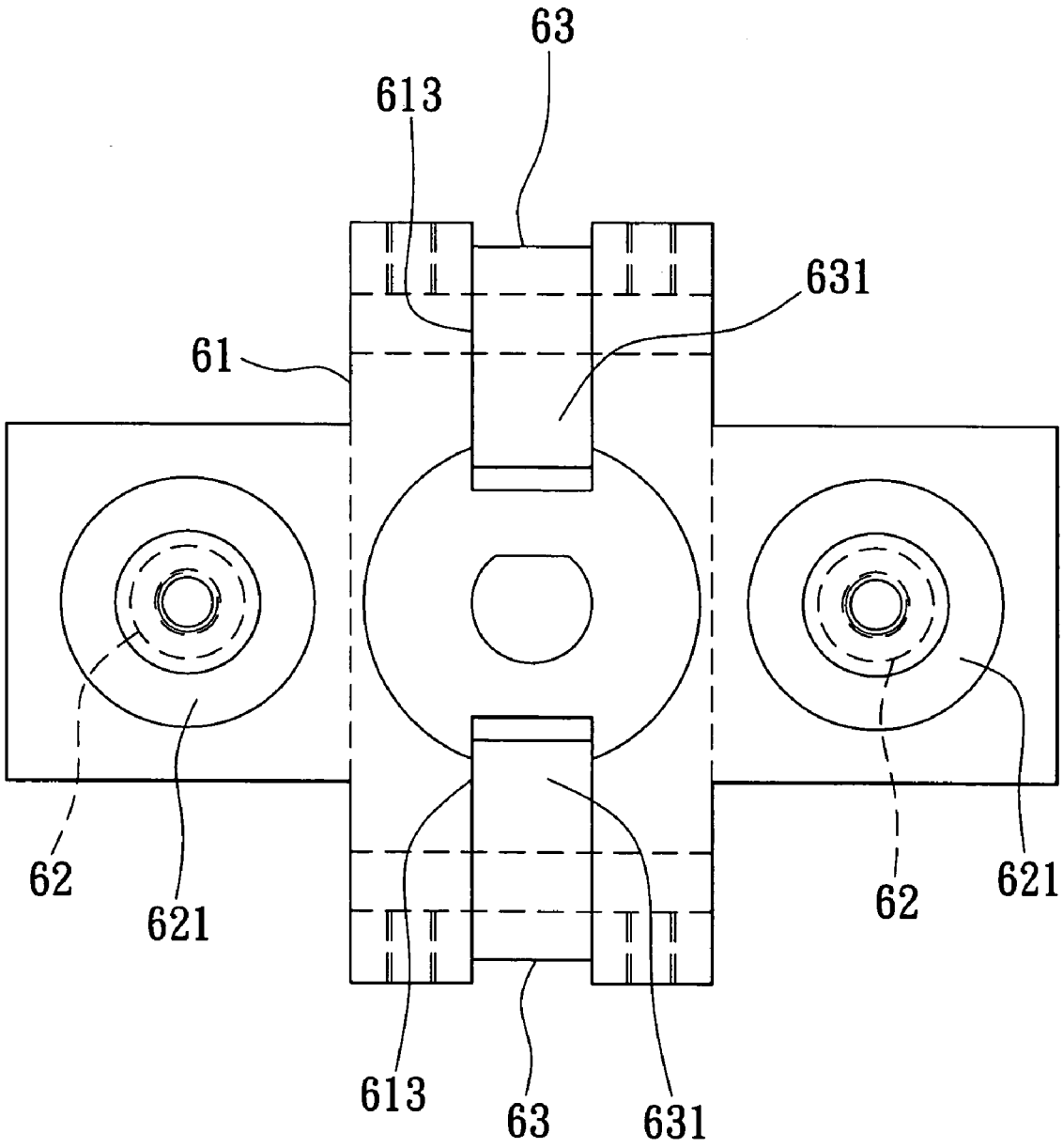
FIG. 4 is a schematic view seen from the left-hand side of FIG. 3, illustrating two restricting members and two thrusting members of an actuating mechanism of the first preferred embodiment, with tubular blocks and a second magnetically attractive member being removed.

Referring to FIG. 1, the first preferred embodiment of a resistance generating device according to the present invention is shown to be mounted on a support stand 3 of a training bicycle (not shown). The training bicycle has a bicycle wheel 7 which is suspended from a ground surface by the support stand 3 to be rotatable relative thereto about a wheel axis by means of a pedaling action. With reference to FIGS. 2 and 3, the resistance generating device of this embodiment is shown to comprise a resistance unit 4, a magnetically inductive unit 5, and an actuating mechanism 6.

The resistance unit 4 includes a seat 41 which is adapted to be mounted on the support stand 3 adjacent to the bicycle wheel 7, a rotatable shaft 43 which is mounted on and which is rotatable relative to the seat 41 about a rotating axis (X) parallel to the wheel axis, and which has an extension segment 431 extending outwardly of the seat 41, and a friction wheel 42 which is mounted on and which is rotatable with the rotatable shaft 43 about the rotating axis (X). The friction wheel 42 is adapted to frictionally engage the bicycle wheel 7 so as to be rotated therewith.

The magnetically inductive unit 5 includes a casing 51 which is fixed to one side of the seat 41 to surround the extension segment 431, a first magnetically attractive member 52 which is fixed to the casing 51 to be spaced apart from the seat 41 and which surrounds the rotating axis (X), a second magnetically attractive member 53 which is mounted on the extension segment 431 to be rotatable with the rotatable shaft 43 at a higher or lower speed, and which is disposed to be spaced apart from the first magnetically attractive member 52 along the rotating axis (X) by a distance (D), and a biasing member 54 which surrounds the extension segment 431 and which abuts against an end of the rotatable shaft 43 and the second magnetically attractive member 53 so as to bias the second magnetically attractive member 53 away from the first magnetically attractive member 52. The first magnetically attractive member 52 is a permanent magnet, or is provided with a permanent magnet thereon. The second magnetically attractive member 53 is made from a metal material with a magnetically attractive property. The second magnetically attractive member 53 is disposed to be displaceable towards or away from the first magnetically attractive member 52 along the rotating axis (X) in response to a higher or lower speed of the second magnetically attractive member 53 so as to increase or decrease a magnetically induced resistance force generated therebetween to be imparted to the bicycle wheel 7.

The actuating mechanism 6 includes amount 61 which is mounted on the extension segment 431 to be rotated therewith and which is disposed between the seat 41 and the second magnetically attractive member 53, a pair of restricting members 62, and two thrusting members 63.

The mount 61 has an axial passage 611 which extends along the rotating axis (X) such that the extension segment 431 of the rotatable shaft 43 passes through the axial passage 611 and an extension 531 of the second magnetically attractive member 53 that extends into the axial passage 611, and two radial holes 613 which extend radially relative to the rotating axis (X) to be communicated with the axial passage 611. The mount 61 further has a pair of tubular blocks 616, each of which defines a passageway 614 extending parallel to the rotating axis (X), and each of which has confronting and abutted ends 6161, 6162 that are proximate to and distal from the second magnetically attractive member 53, respectively.

Figure 5:
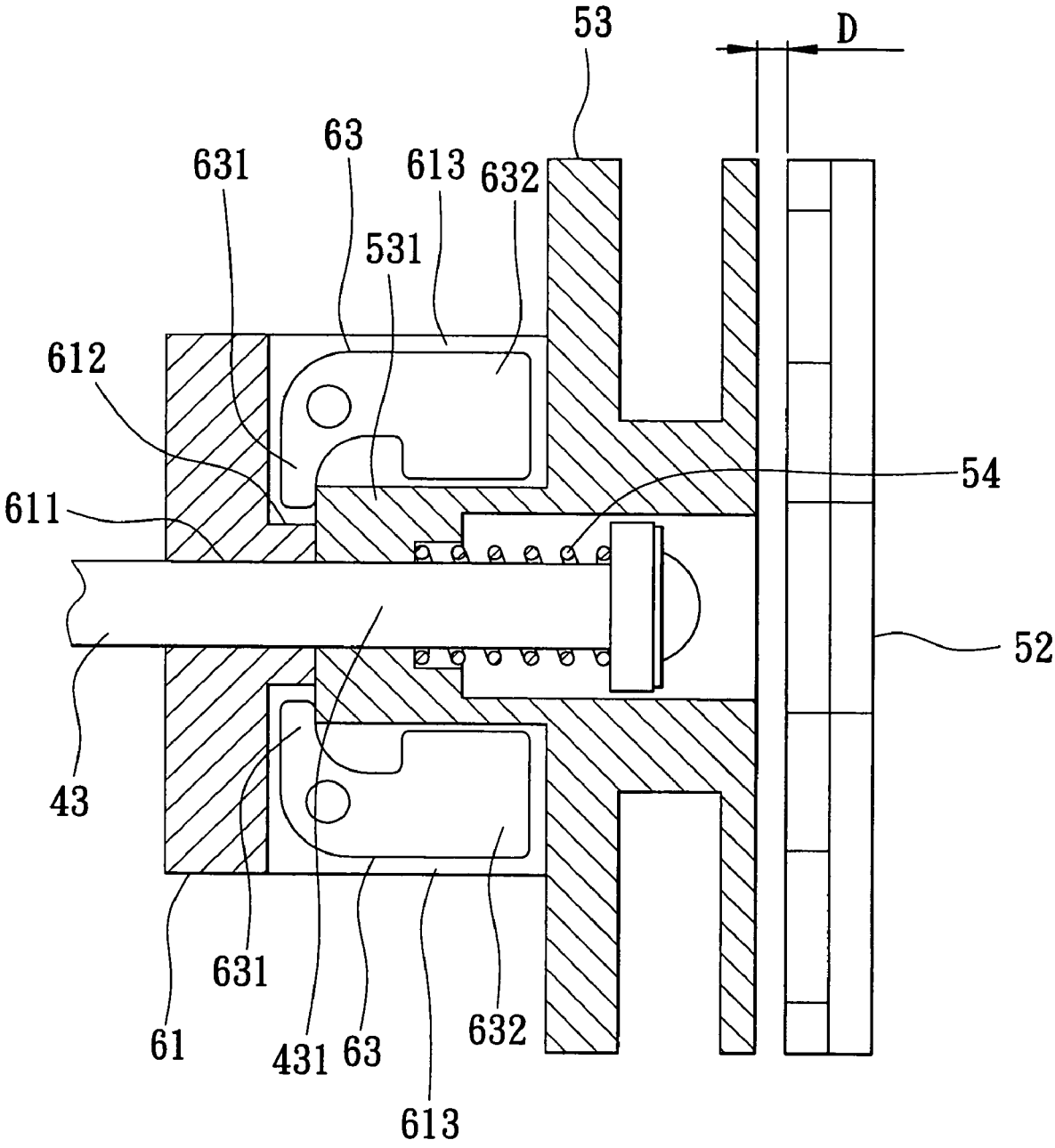
FIG. 5 is a fragmentary sectional view illustrating the thrusting members of the actuating mechanism of the first preferred embodiment in a normal position.
Figure 6:
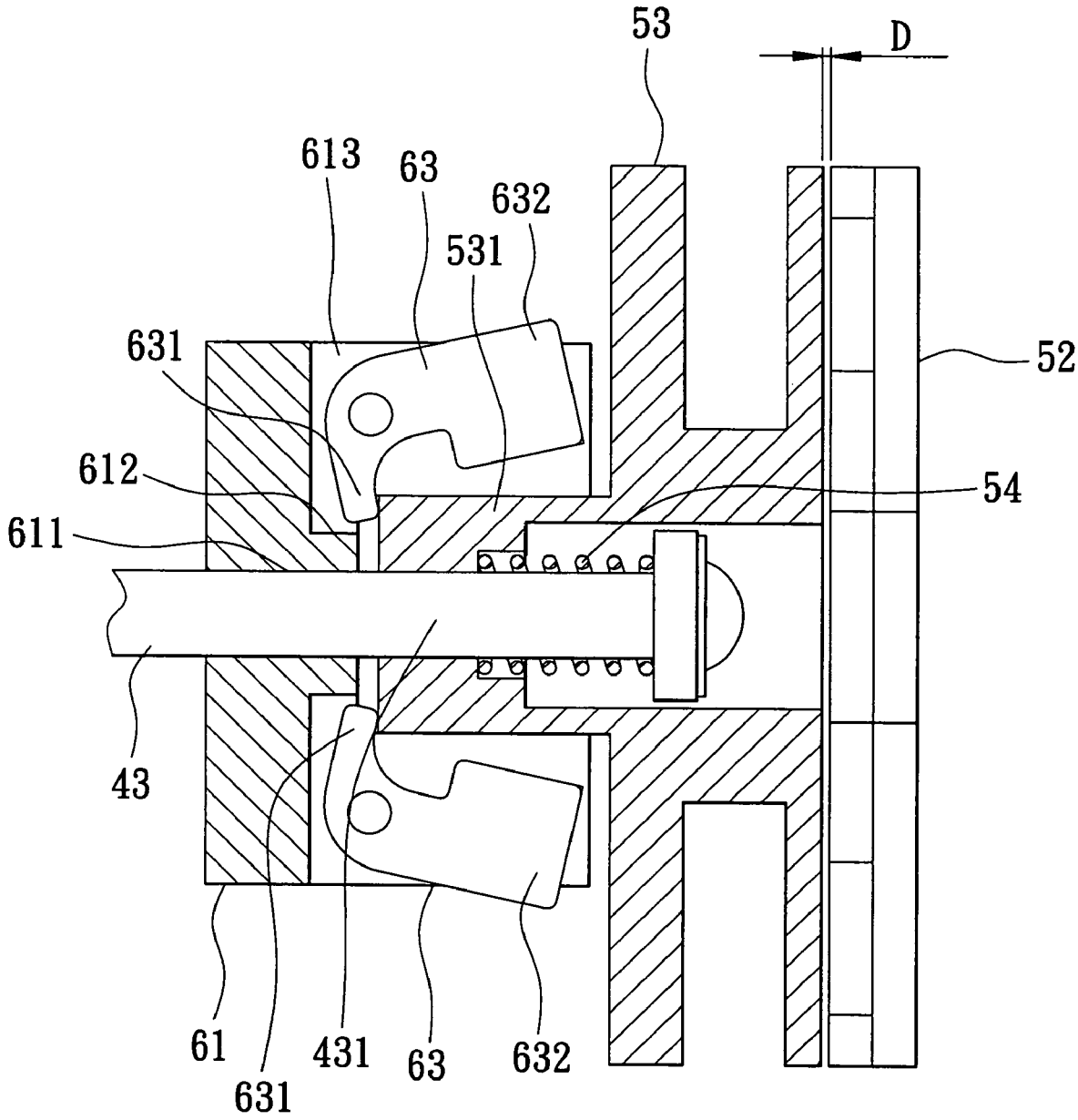
FIG. 6 is a fragmentary sectional view similar to FIG. 5, illustrating the thrusting members in a thrusting position.

With reference to FIGS. 5 and 6, each of the thrusting members 63 is received in the respective radial hole 613 to be rotated with the rotatable shaft 43, and has a fulcrum which is pivoted to the mount 61 about a pivoting axis, and a flung end 632 and a pressing end 631 at two opposite sides of the fulcrum such that the flung end 632 is flung more outwardly by an increased centrifugal force during the rotation of the rotatable shaft 43 at the higher speed from a normal position (as shown in FIG. 5) to turn the pressing end 631 is further about the pivoting axis to a thrusting position (as shown in FIG. 6) so as to press the extension 531 of the second magnetically attractive member 53 closer to the first magnetically attractive member 52 against the biasing action of the biasing member 54, thereby increasing the magnetically induced resistance force.

Moreover, the mount 61 includes a tubular barrier 612 which is disposed to surround the extension segment 431 and which confronts the extension 531 along the rotating axis (X) so as to restrict the shifting movement of the second magnetically attractive member 53 away from the first magnetically attractive member 52.

Referring again to FIG. 3, each of the restricting members 62 has a shank 622 which is disposed to extend from the second magnetically attractive member 53 through the respective passageway 614 to terminate at a joining end, and an enlarged head 621 which is connected to the joining end of the shank 622 and which is configured to abut against the abutted end 6162 when the second magnetically attractive member 53 is brought to move towards the first magnetically attractive member 52, thereby restricting the shifting movement thereof.

As illustrated, when the bicycle wheel 7 is initially rotated by a pedaling action, the friction wheel 42 and the rotatable shaft 43 are rotated therewith such that a magnetically induced resistance force is generated between the first and second magnetically attractive members 52, 53 and imparted to the bicycle wheel 7. Thereafter, as the rotation speed of the bicycle wheel 7 increases, the thrusting members 63 are displaced to the thrusting position by virtue of an increased centrifugal force to press the second magnetically attractive member 53 to be closer to the first magnetically attractive member 52, thereby increasing the resistance force imparted to the bicycle wheel 7. The higher the rotation speed, the larger will be the resistance force. Hence, a good training effect of the training bicycle can be achieved.

It is noted that the second magnetically attractive member 53 also may be a permanent magnet and the first magnetically attractive member 52 may be made from a metal material with a magnetically attractive property.

Figure 7:
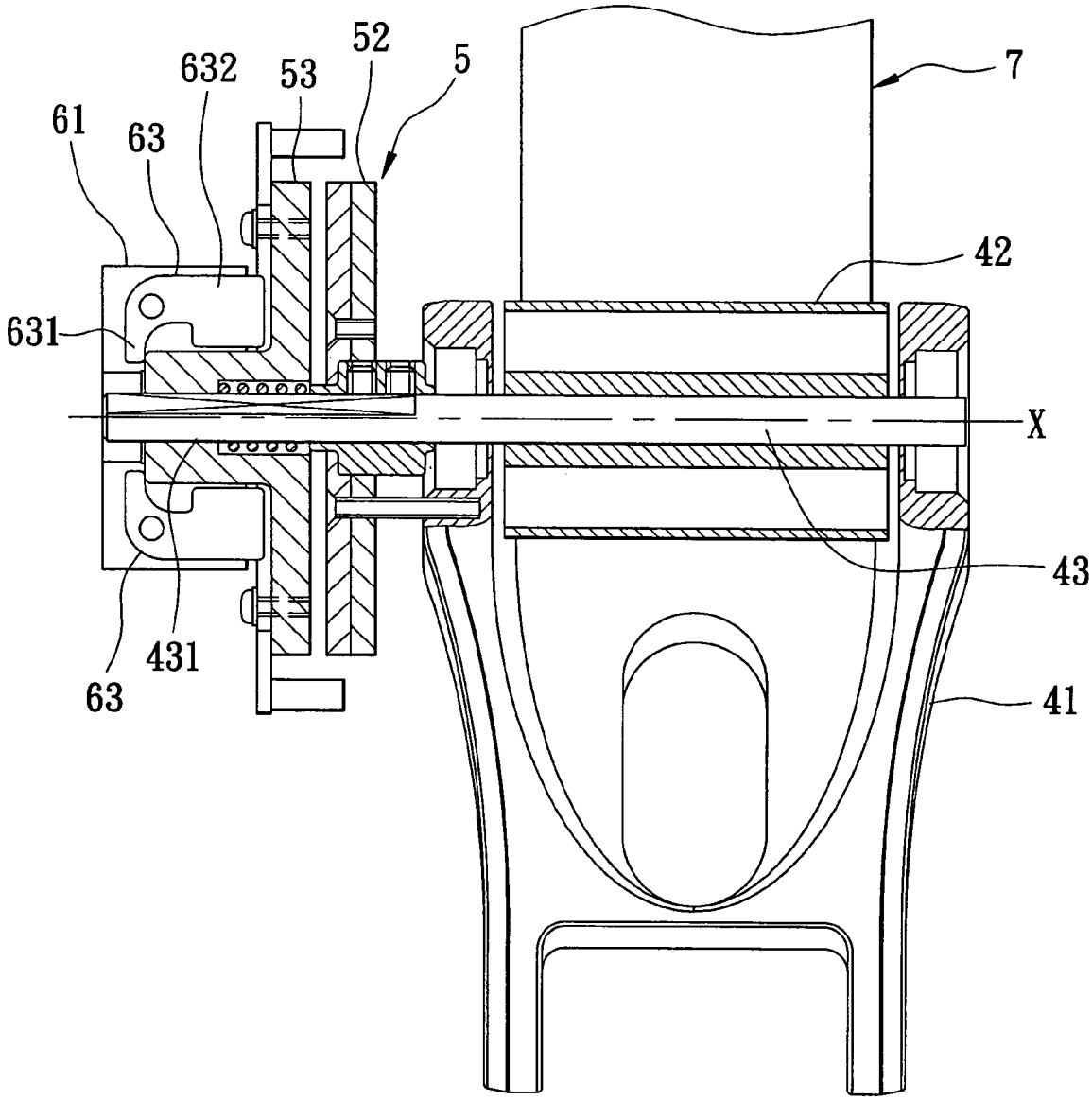
FIG. 7 is a sectional view of the second preferred embodiment of a resistance generating device according to this invention.

Referring to FIG. 7, the second preferred embodiment of a resistance generating device according to this invention is shown to be similar to the first preferred embodiment in construction. One difference resides in that the arrangement of the first and second magnetically attractive members 52, 53 and the actuating mechanism 6 is changed. The first magnetically attractive member 52 in the second preferred embodiment is disposed closer to the seat 41 than the second magnetically attractive member 53 and the actuating mechanism 6.

Figure 8:
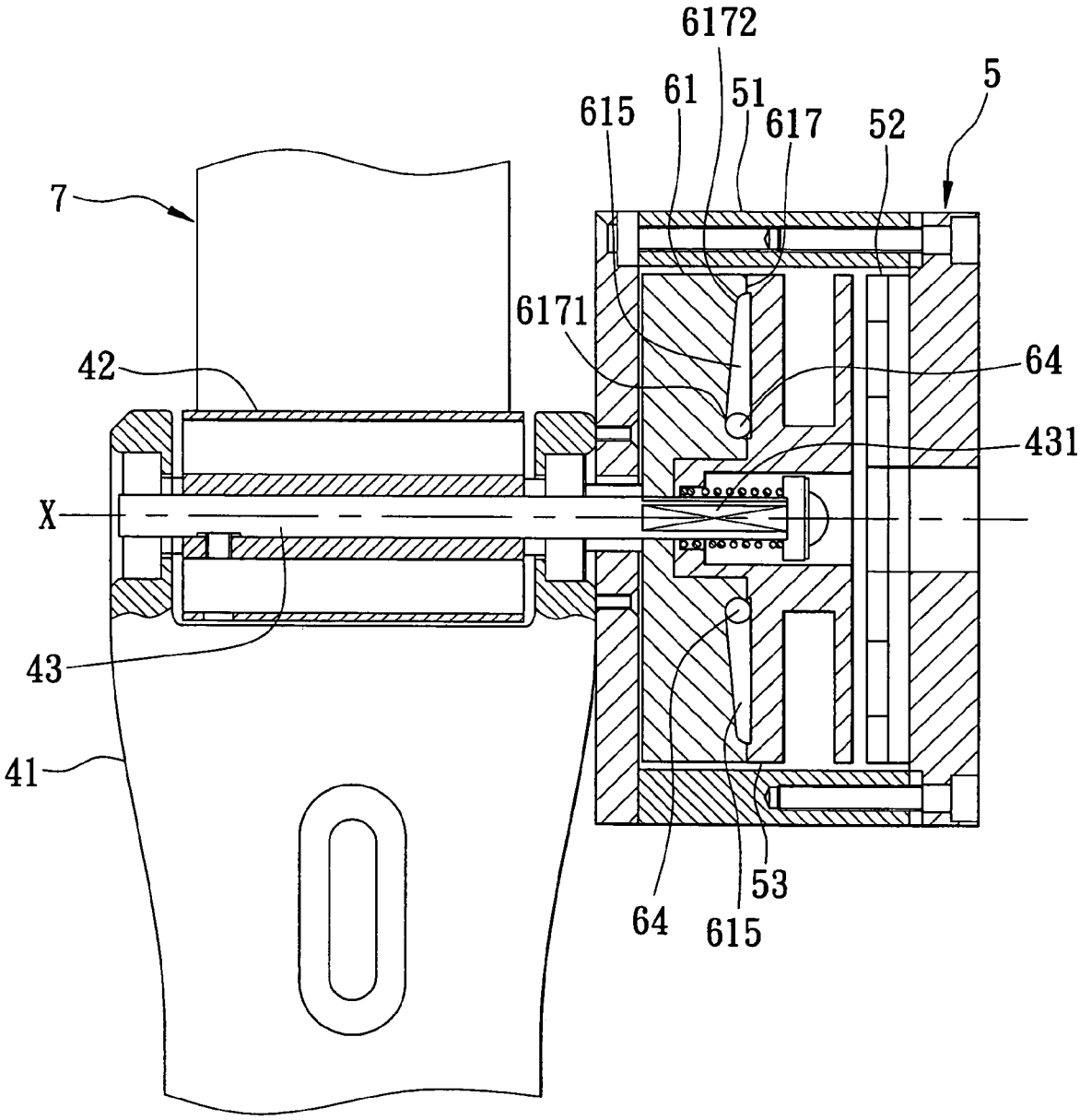
FIG. 8 is a sectional view of the third preferred embodiment of a resistance generating device according to this invention.

Referring to FIG. 8, the third preferred embodiment of a resistance generating device according to this invention is shown to be similar to the first preferred embodiment in construction. In this embodiment, the mount 61 has an annular end wall 617 confronting and cooperating with the second magnetically attractive member 53 to define two recesses 615 therebetween. Each of the recesses 615 extends radially relative to the rotating axis (X), and is configured such that the end wall 617 has proximate and distal regions 6171, 6172 relative to the rotatable shaft 43. The proximate and distal regions 6171, 6172 are distal from and proximate to the second magnetically attractive member 53, respectively.

Each of the thrusting members 63 is in form of a roller 64 which is movably received in the respective recess 615, such that the roller 64 is moved by virtue of the increased centrifugal force from the proximate region 6171 to the distal region 6172 so as to place the second magnetically attractive member 53 in the thrusting position.

Figure 9:
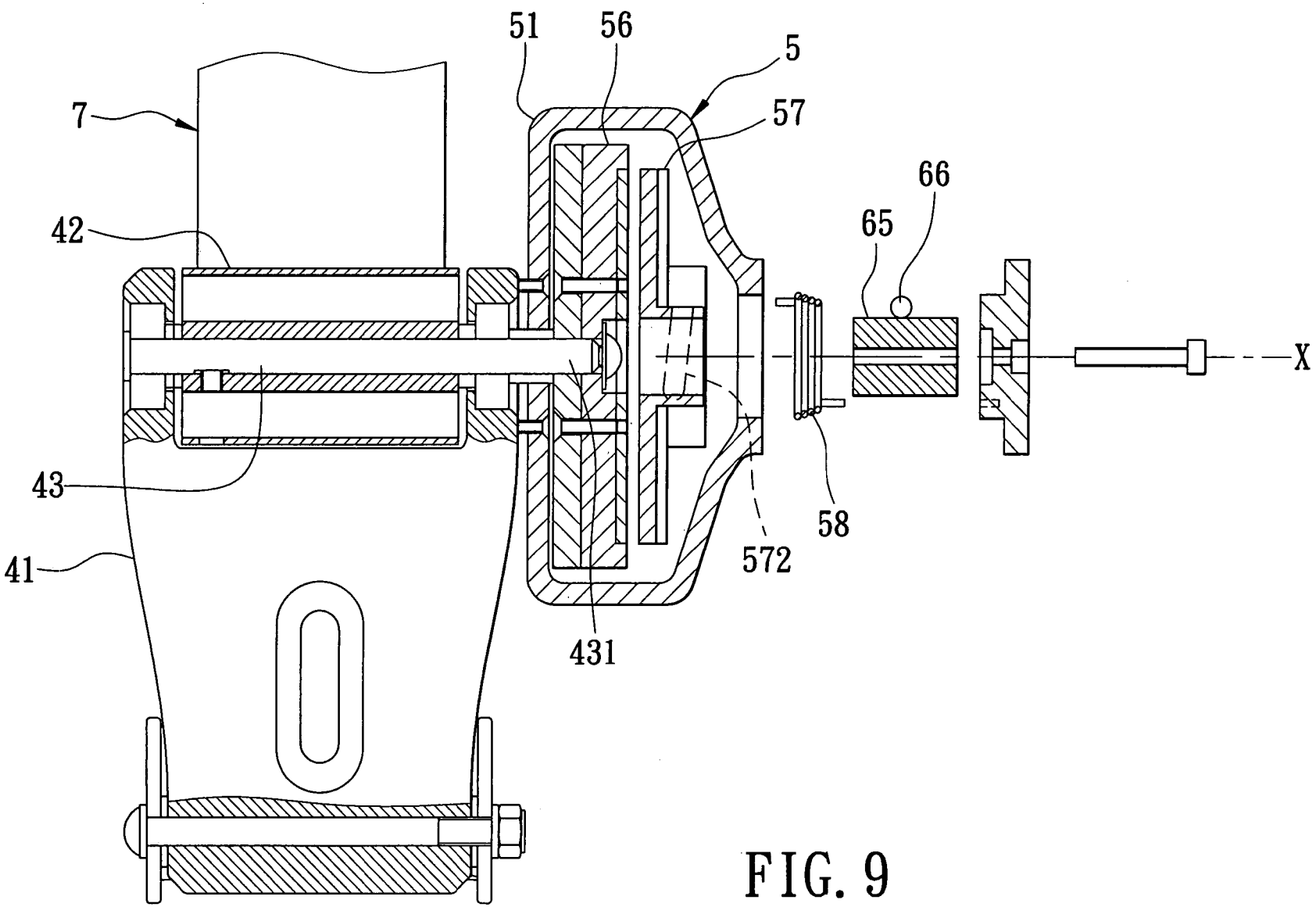
FIG. 9 is an exploded sectional view of the fourth preferred embodiment of a resistance generating device according to this invention.
Figure 10:
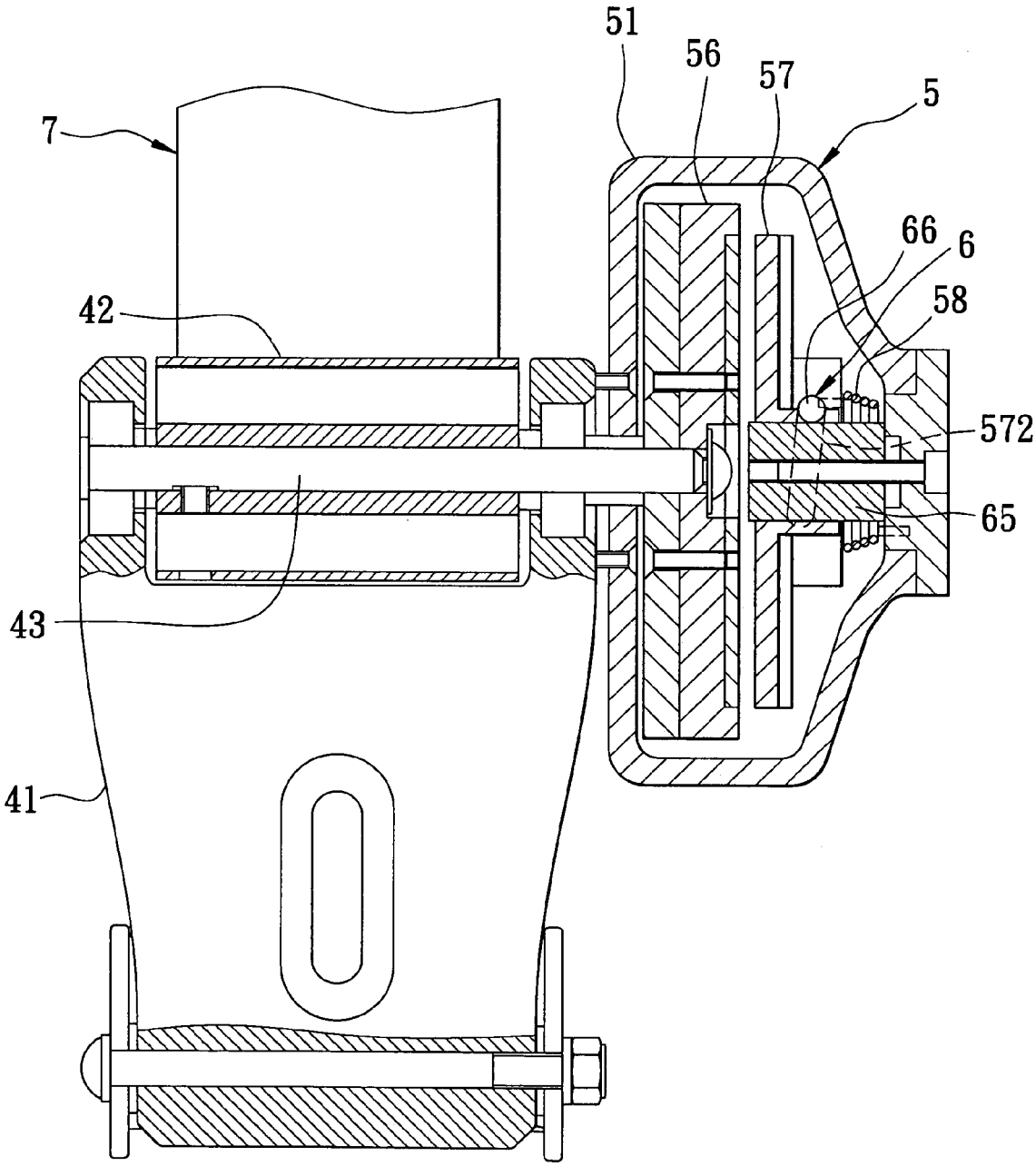
FIG. 10 is a sectional view of the fourth preferred embodiment.

Referring to FIGS. 9 and 10, the fourth preferred embodiment of a resistance generating device according to this invention is shown to be similar to those of the previous embodiments. The difference resides in that the actuating mechanism 6 includes a stem 65 and a cam mechanism. The stem 65 is fixed on the casing 51, extends along the rotating axis (X), and is spaced apart from the rotatable shaft 43. The first magnetically attractive member 57 surrounds the stem 65 and is shiftable relative to the stem 65 along the rotating axis (X). The cam mechanism includes a cam surface 572 in the form of a groove formed in the first magnetically attractive member 57, and a cam follower 66 in the form of a stud secured to the stem 65. Thus, when the first magnetically attractive member 57 is dragged to rotate relative to the stem 65 by a torque which is imparted to the first magnetically attractive member 57 as a result of accelerating rotation of the second magnetically attractive member 56 to the higher speed, the cam follower 66 is moved along the cam surface 572 so as to shift the first magnetically attractive member 57 towards the second magnetically attractive member 56. The biasing member 58 is a torsion spring which is disposed to bias the first magnetically attractive member 57 to return to the normal position to be away from the second magnetically attractive member 56.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A resistance generating device for a training bicycle which has a support stand to suspend a bicycle wheel from a ground surface to permit rotation of the wheel relative thereto about a wheel axis by means of a pedaling action, comprising:

a seat which is adapted to be mounted on the support stand adjacent to the bicycle wheel;

a rotatable shaft which is mounted on and which is rotatable relative to said seat about a rotating axis parallel to the wheel axis;

a friction wheel which is mounted on and which is rotatable with said rotatable shaft about the rotating axis, said friction wheel being adapted to frictionally engage the bicycle wheel so as to be rotated therewith;

a first magnetically attractive member disposed to surround the rotating axis, a second magnetically attractive member which is mounted to be rotatable with said rotatable shaft at a higher or lower speed, and which is disposed to be spaced apart from said first magnetically attractive member along the rotating axis, said first and second magnetically attractive members being configured to be shiftable towards or away from each other along the rotating axis in response to the higher or lower speed of said second magnetically attractive member so as to increase or decrease a magnetically induced resistance force generated therebetween to be imparted to the bicycle wheel;

a biasing member disposed to bias said first and second magnetically attractive members away from each other; and an actuating mechanism having a mount which is mounted on and is rotated with said rotatable shaft, and a thrusting member a fulcrum pivoted to said mount about a pivoting axis, the thrusting member includes a flung end and a pressing end at two opposite sides of said fulcrum such that said flung end is flung more outwardly by an increased centrifugal force resulting from the rotation of said rotatable shaft at the higher speed from a normal position to a thrusting position, and said pressing end is further turned about the pivoting axis, thereby pressing said second magnetically attractive member to move closer to said first magnetically attractive member against the biasing force of said biasing member so as to increase the magnetically induced resistance force.

2. The resistance generating device of claim 1, wherein said mount has an axial passage which extends along the rotating axis for passage of said rotatable shaft therethrough, and a radial hole which extends radially relative to the rotating axis to be communicated with said axial passage for receiving said thrusting member therein.

3. The resistance generating device of claim 2, wherein said second magnetically attractive member has an extension which extends into said axial passage to engage said pressing end to be pressed thereby, said mount including a tubular barrier which is disposed to surround said rotatable shaft and which confronts said extension along the rotating axis so as to restrict the shifting movement of said second magnetically attractive member away from said first magnetically attractive member.

4. The resistance generating device of claim 2, wherein said mount includes a pair of tubular blocks, each of which defines a passageway extending parallel to the rotating axis, and each of which has confronting and abutted ends that are proximate to and distal from said second magnetically attractive member, respectively, said resistance generating device further comprising a pair of restricting members, each having a shank which is disposed to extend from said second magnetically attractive member through said passageway to terminate at a joining end, and an enlarged head which is connected to said joining end and which is configured to abut against said abutted end when said second magnetically attractive member is brought to move towards said first magnetically attractive member, thereby restricting the shifting movement.

5. The resistance generating device of claim 1, wherein said first magnetically attractive member is a permanent magnet.

* * * * *